United States Patent [19]

Kraemer et al.

[11] Patent Number: 4,913,633

[45] Date of Patent: Apr. 3, 1990

[54] FUEL INJECTION PUMP FOR INTERNAL COMBUSTION ENGINES

[75] Inventors: Manfred Kraemer, Schwieberdingen; Thomas Kulder, Kornwestheim; Johann Warga, Bietigheim-Bissingen, all of Fed. Rep. of Germany

[73] Assignee: Robert Bosch GmbH, Stuttgart, Fed. Rep. of Germany

[21] Appl. No.: 237,196

[22] Filed: Aug. 29, 1988

[30] Foreign Application Priority Data

Oct. 24, 1987 [DE] Fed. Rep. of Germany ..... 3736091

[51] Int. Cl.[4] ..... F02M 59/24; F02M 59/44

[52] U.S. Cl. ..... 417/499

[58] Field of Search ..... 417/494, 499; 123/500, 123/501, 503

[56] References Cited

U.S. PATENT DOCUMENTS

| | | | |
|---|---|---|---|
| 3,385,221 | 5/1968 | Parks | 417/494 |
| 4,619,233 | 10/1986 | Yamaguchi | 123/357 |
| 4,661,051 | 4/1987 | Nakamura et al. | 417/499 |
| 4,706,626 | 11/1987 | Hafele et al. | 123/503 X |
| 4,737,085 | 4/1988 | Guntert et al. | 417/494 X |
| 4,754,737 | 7/1988 | Jshida et al. | 123/500 |

FOREIGN PATENT DOCUMENTS

| | | | |
|---|---|---|---|
| 5969 | 10/1987 | World Int. Prop. O. | 123/501 |

*Primary Examiner*—Leonard E. Smith
*Attorney, Agent, or Firm*—Edwin E. Greigg

[57] ABSTRACT

A fuel injection pump for internal combustion engines having a plurality of pump elements disposed in a row, the onset and end of supply of each being effected by means of a respective control slide that is axially displaceable on the pump piston and by the control of relief conduits for the pump work chamber. The control slides are actuated via a rotary shaft; upon rotation of the rotary shaft, the control slides are axially displaced via driver arms secured on the rotary shaft. To adjust the axial position of the individual control slides relative to one another, the driver arms are permanently deformed in the axial direction of the control slides.

14 Claims, 2 Drawing Sheets

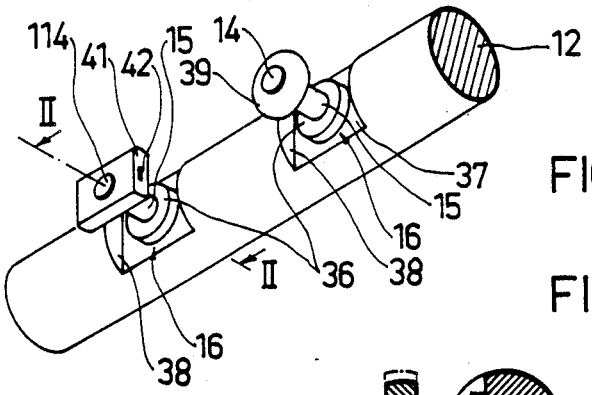
FIG. 2
FIG. 3
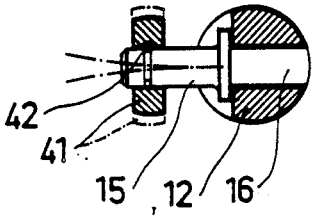
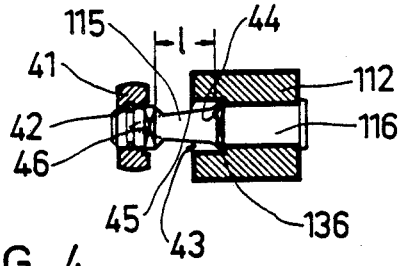
FIG. 4
FIG. 5
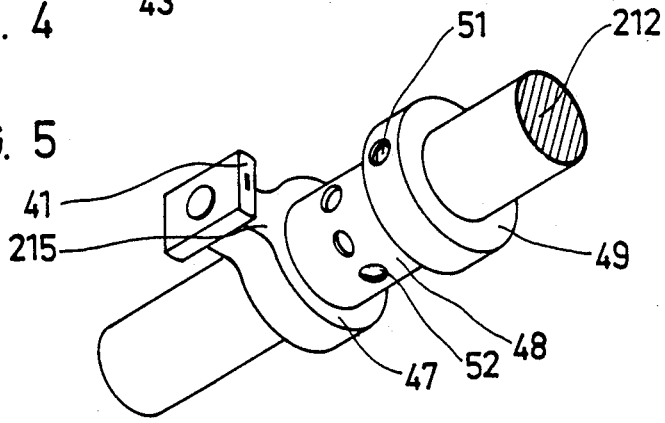

FUEL INJECTION PUMP FOR INTERNAL COMBUSTION ENGINES

BACKGROUND OF THE INVENTION

The invention is based on a fuel injection pump as defined hereinafter.

Before fuel injection pumps of this kind, embodied as multi-cylinder pumps having a series of pump elements, are put into operation, an exact association of the individual control slides with respect to the various control openings must be made, since during pump operation the individual control slides are displaced simultaneously and in common by the rotary shaft, for variation of the instant of injection or the injection quantity. Even slight errors in this association, that is, differences in the desired control points of the various control slides with respect to one another, can lead to considerable errors in the control of injection onset or injection quantity, which in turn can for instance lead to rough engine operation or excessively noisy combustion.

These deviations in the association of the individual control slides with respect to one another are due to tolerances originating in the machining or assembly process, or in the pump drive shaft, and the deviations can be superimposed on one another. These deviations must be eliminated, by positioning the control slides uniformly with respect to the control openings before the pump is put into operation.

In a known fuel injection pump of this generic type (German Offenlegungsschrift 35 22 414), the driver tang is secured to a clamping ring encompassing the rotary shaft; once the clamping ring is loosened, the position of the tang, and thus the axial position of the control slide relative to the rotational position of the rotary shaft, can be varied. Not only does the adjusted position between the driver arm and rotary shaft shift on its own, given the heavy loads and constant jarring that a fuel injection pump undergoes, but adjustment is also a relatively labor-intensive operation because it requires making a direct comparison between the various pump elements; moreover, when the clamping rings are adjusted on the rotary shaft, they may exert torque upon the shaft that can lead to further errors in adjustment A further disadvantage is that the adjustment can be done only in the installed condition; only then can the individual association between the change in rotational position of the rotary shaft and the clamping ring, on the one hand, and the change in axial position of the control slide, on the other, be reliably performed, which has the disadvantage that for adjustment, an intervention into the suction chamber must be made when it is at feed pump pressure.

In another known fuel injection pump of this generic type (German Offenlegungsschrift 35 40 052), the driver arm is disposed eccentrically on a spindle that penetrates the rotary shaft radially and is clamped to it with a tightening nut. When the spindle is rotated, which is done by engaging a slit with a screwdriver after the tightening nut is loosened, the driver arm is adjusted as a function of its eccentricity with respect to the axial position of the control slide. In this known apparatus as well, the fact that the adjustment, once made, loosens on its own again is all the more disadvantageous, the smaller the friction faces involved in the tightening of the spindle. Also, once again this adjustment can be performed only with the rotary shaft in its installed state, and once again the suction chamber, which is under pressure, must be opened up.

In yet another known fuel injection pump of this generic type (European patent application 0181 402), a fork-like device having a gripper insert acts as the driver element; it is connected to the rotary shaft either with a tubular clamp, in which case the rotary shaft is round in cross section, or via a bolt, disposed on the face end of the forked lever facing the rotary shaft, which in that case has a polygonal cross section. Although in the first case adjustment is relatively simply done by rotating the "tubular clamp" on the rotary shaft, there is still the danger that jarring in such systems easily loosens the clamp tension and can cause the control slide association to change, possibly in the direction of increasing fuel quantity, which will cause the engine to race. The second case is extremely unfavorable in terms of force transmission, because the area of contact, between the lever and the rotary shaft, that is operative in the longitudinal direction of the lever is relatively narrow, and moreover, as noted above, the desired adjustability is not available.

OBJECT AND SUMMARY OF THE INVENTION

The fuel injection pump according to the invention has the advantage over the prior art that a very accurate adjustment is attained by means of a permanent deformation, which does not change from jarring or loads during operation and is extremely favorably attained. This deformation is performed with the rotary shaft in the disassembled state, after the axial deviations have been measured with the rotary shaft in the assembled state. The forces required for the plastic deformation are must greater than those for actuating the control slides, which precludes material deformation during operation. Above all, the fastening element can have a non-releasable connection with the rotary shaft.

In an advantageous feature of the invention, a bolt that penetrates the rotary shaft and can be riveted or screwed to it is used as the fastening element. For the adjustment according to the invention, the driver arm can advantageously be rigidly joined to the rotary shaft, for instance with rivets. Naturally the connection can also be effected by hard soldering or welding, but that has the disadvantage of involving an additional heat treatment.

In a further advantageous feature of the invention, a flattened face or recess is provided on the rotary shaft in the vicinity of the bolt, and there is at least one protrusion limiting the flattened face or recess on at least one side, and a complementary feature is provided on the bolt, serving to secure the bolt against relative rotation. For example, if the rotary shaft has a circular cross section, then the flattening can be obtained by removing material transversely to the axis of the rotary shaft; the segmental surface then formed between the remaining cylindrical surface and flattened face acts as a stop against rotation, to which end, however, the fastening element on which the driver arm is disposed is profiled accordingly, for instance having a square profile. With a rotary shaft of profiled cross section, for instance a rectangular or square cross section, the profiled faces can serve as a flattened face; if they are suitably embodied, for instance as longitudinal recesses, and if the fastening element is profiled for cooperation with them, then a means of fixation against relative rotation is attained.

In a major feature of the invention, the driver arm is tapered toward the free end, and the longitudinal cross section is preferably paraboloid, so that a uniform bending tension is exerted on the arm length when the driver arm is deformed. With this kind of third-order paraboloid, the force during the cold deformation is introduced at the apex, resulting in a uniform deformation over the entire bending range, that is, over the bendable length of the driver arm. The result, above all, is that fissures and hence permanent damage to the driver arm are not produced (see *DubbelTaschenbuch fur den Maschinenbau* [Dubbel's Handbook of Mechanical Engineering], Volume 1, 1955, pages 131 and 346). In the vicinity of the bendable arm length, instead of being embodied as a paraboloid the driver arm can be embodied approximately as a cone, which is particularly easy, because the free end of the driver arm becomes a reinforced, cylindrical tang.

In another advantageous feature of the invention, the fastening element is a sleeve, encompassing the rotary shaft and having a thin, deformable section disposed between two reinforced collars at its ends. One collar is fastened to the rotary shaft in a manner fixed against relative rotation, while the other collar is merely supported on the shaft and carries the driver arm. Naturally, this embodiment is possible only with a round rotary shaft, to enable the corresponding relative rotation of the second collar. To facilitate the plastic deformation, slits or bores may be provided in the deformable section.

In a further feature of the invention, which is equally applicable to the above-mentioned features, the free end of the driver arm has a cylindrical tang, on which a slide block that engages a transverse groove in the control slide is supported with a central bore; the slide block is secured against axial displacement on the tang. This advantageously makes for a line contact between the slide block and the control slide groove, which reduces wear.

The invention will be better understood and further objects and advantages thereof will become more apparent from the ensuing detailed description of preferred embodiments taken in conjunction with the drawings.

BRIEF DESCRIPTION OF THE DRAWINGS

FIG. 2 is a perspective view showing two variants of the first exemplary embodiment;

FIG. 3 is a section taken along the line II of FIG. 2;

FIG. 4 is a corresponding section taken through a third variant of the second exemplary embodiment; and FIG. 5 is a perspective view of the second exemplary embodiment.

DESCRIPTION OF THE PREFERRED EMBODIMENTS

Figure 1:
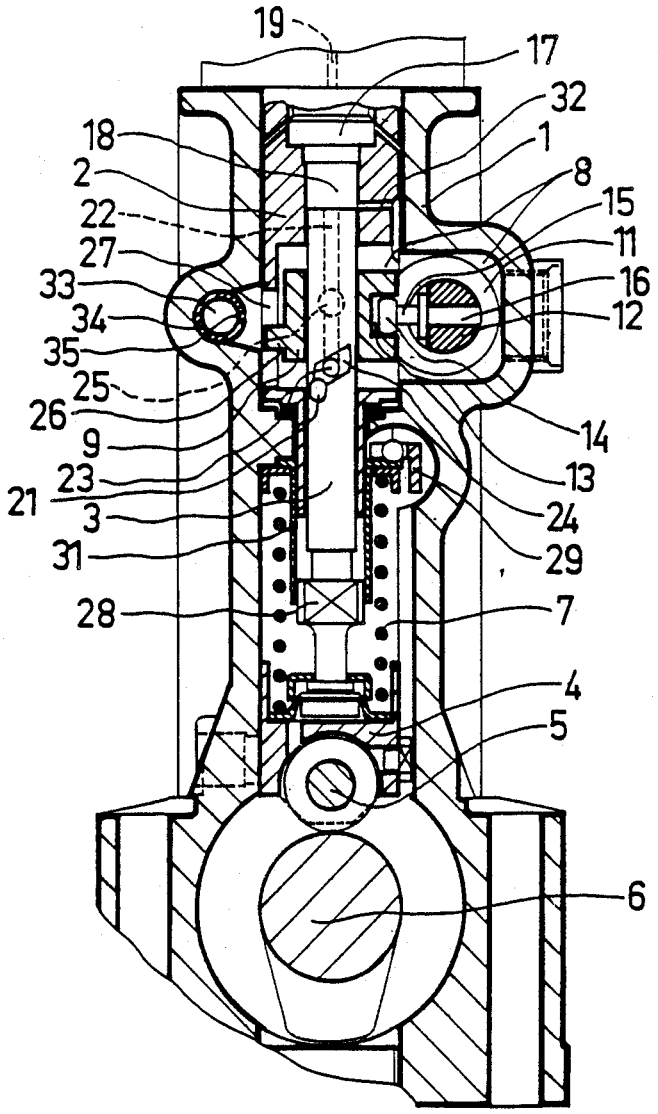
FIG. 1 is a vertical cross section through a fuel injection pump according to the invention.

The fuel injection pump shown in FIG. 1 is equally applicable for both exemplary embodiments of the invention. In this pump, a plurality of cylinder liners 2 are disposed in line in a housing 1, only one of them being visible because of where the section is taken. In each of the cylinder liners 2, one pump piston 3 is driven for its axial motion forming the working stroke by a camshaft 6, via an interposed roller tappet 4 having a roller 5, counter to the pump feed pressure and counter to the force of a spring 7. Recesses in the cylinder liners 2 and hollow spaces in the housing 1 defined a suction chamber 8, for the pump elements embodied by the cylinder liners 2 and pump pistons 3. One control slide 9 is axially displaceably disposed on each of the pump pistons 3, in the recesses of the cylinder liners 2. The suction chamber 8 is closed at its longitudinal ends by bearing plates 11, one of which is shown in plan view, and in which a rotary shaft 12 disposed in the suction chamber 8 is supported. A transverse groove 13 in the control slide is engaged by a driver tang 14 of a driver arm 15 of the rotary shaft 12, the tang being joined to the rotary shaft with a fastening element 16.

The pump piston 3, the cylinder liner 2 and a pressure valve 17 define a pump work chamber 18, from which a pressure conduit 19 leads to a pressure line, not shown, that ends at an injection valve of the engine. Provided in the pump piston 3 are a blind bore 22, which terminates at the face end of the pump piston and discharges into the pump work chamber 18, and a tranverse bore 23, which discharges into oblique grooves 24; one oblique groove 24 each is disposed on opposite sides of the jacket face of the pump piston 3. These oblique grooves 24 terminate at the bottom in countersunk bores 21 and cooperate with radial bores 25 of the control slide 9.

To secure the control slide 9 against rotation as it is axially displaced on the pump piston 3, and to assure precise association of the oblique grooves 24 with respect to the radial bores 25, the control slide 9 has a protrusion 26, with which it engages a longitudinal groove 27 of the cylinder liner 2.

The pump piston 3 has flattened faces 28 on its lower end, which are engaged by a bushing 31 that is rotatable in a known manner by a governor rod 29, so that an axial displacement of the governor rod 29 causes a rotation of the pump piston 3 and hence a change in the association of the oblique grooves 24 relative to the radial bores 25.

A suction bore 32 extends in the cylinder liner 2 and in the pump housing 1, betwen the suction chamber 8 and the pump work chamber 18; this bore 32 is opened by the pump piston 3 when it is at bottom dead center (as shown in the drawing).

The supply of fuel to the suction chamber 8 is effected via the longitudinal groove 27 from an inflow conduit 33, which extends in a tube 34 that is disposed in the housing 1 and has branch openings 35 toward the longitudinal grooves 27.

OPERATION

This fuel injection pump functions as follows:

Toward the end of the intake stroke, or at the bottom dead center position of the pump piston 3, fuel flows via the oblique grooves 24, the transverse bore 23 and the blind bore 22 as well as the suction bore 32 into the work chamber 18 and fills it. Then as soon as the roller tappet 4 is displaced upward via the roller 5, in the course of further rotation of the camshaft 6, the pump piston 3 positively displaces fuel from the pump work chamber 18. Until the oblique grooves 24 and the countersunk bores 21 have become entirely immersed in the control slide 9, pumping takes place from the pump work chamber via the above-described route, back to the suction chamber 8; initially, a certain quantity is still positively displaced back via the suction bore 32. As long as the oblique grooves with the countersunk bores 21 are completely immersed in the control slide 9, an injection pressure can build up in the pump work chamber 18; after that, the pumping of fuel to the engine takes place via the pressure conduit 19. This actual injection stroke of the pump piston 3 is interrupted whenever the oblique grooves 24 coincide with the radial bores 25, causing the fuel to be pumped back into the suction chamber 8 from the pump work chamber 18.

Depending on the rotational position of the pump piston 3, which is determined by the governor rod 29, this actual injection stroke is of variable length, because as a function of this rotational position, the oblique grooves 24 coincide with the radial bores 25 only after a certain length of stroke. This determines the injection quantity. The injection onset, contrarily, is determined by the axial position of the control slide 9, which in turn is determined by the rotary shaft 12, that is, by its driver arm 15 and driver tang 14. The higher the level to which the control slide is displaced, the later does the injection onset occur (which takes place when the oblique grooves 24 become immersed in the control slide 9), and correspondingly the later does the injection cease, so that the fuel quantity, which is determined by the rotational position of the pump piston 3, remains unaffected. This onset or end of injection must agree, for all the pump elements of one row.

Since dimensional deviations within a given tolerance range are unavoidable in the manufacture and assembly of a fuel injection pump, they must be corrected before the fuel injection pump is used on the engine. That is, at a particular rotational position of the rotary shaft 12, all the control slides 9 must assume specific axial positions with respect to the oblique grooves 24, so that the angular difference of the cylinders with respect to one another at the onset of pumping is always uniform. This is attained in that the position of the driver tang 14 with respect to the rotational position of the rotary shaft 12 is changed by adapting the position of the various driver tangs to one another or to the control slides 9; this is done by deforming the driver arm 15 or fastening element 16.

In the first exemplary embodiment, shown in FIGS. 2–4, this change is done by bending the driver arm 15. In FIG. 2, a portion of the rotary shaft 12 is shown, having two built-in driver arms 15, which are secured to the rotary shaft 12 via a fastening element 16 that is disposed at intervals on the rotary shaft 12. The fastening element 16 has a flange 36 which is proximate to this end, that rests on a flattened face 37 of the rotary shaft 12. The fastening itself may be rigid or releasable, for instance being in the form of a screwed, riveted or soldered connection. If a riveted connection is used, the loosening of which could allow rotation of the driver arm, then the flange 36 may have a profiled cross section, so that it is supported on at least one of the segmental faces 38 of the flattened face 37 and is prevented from rotating on its own. If the driver arm 15 were to rotate, the intentional bending that is performed might take place in the opposite direction from that desired.

In the two variants shown in FIG. 2, a separate driver is provided for transmitting the rotational motion from the driver arm 15 to each control slide 9. In the first variant, on the right in FIG. 2, the driver 39 is embodied as an annular collar, rounded in spherical segmental form on the outside, which is formed onto the driver tang 14 and is secured against falling out. In the second variant shown in FIG. 2, the driver 41 is embodied as a slide block and is secured against axial displacement and hence against falling out, by means of a locking key 42 and with a certain amount of rotational play, on the end of the driver arm 15 embodied as a driver tang.

In FIG. 3, this variant is shown in section; the dot-dash line indicates the directions in which the bending is possible, and how the position of the slide block 41 would change in each case.

In the third variant of this first exemplary embodiment, shown in FIG. 4, the rotary shaft 112 is embodied as a profiled bar of rectangular cross section, in which there is a longitudinal groove 43. This longitudinal groove has a bottom face 44 and side faces 45. The fastening element 116 is embodied as a rivet, with a flange 136 of square cross section, so that the side faces of the flange 136 cooperate with the side faces 45 of the longitudinal groove 43 in such a way that the driver arm 115 is prevented from rotating. The driver arm 115 itself is embodied conically, in the ideal case parabolically, with a cross section that tapers away from the rotary shaft. In the ideal case, that is, the parabolic case, this assures that with forces engaging the free end of the driver arm 115 in order to bend it, constant bending tensions will prevail over the entire bendable arm length, which above all prevents breakage or unilateral overloading of the driver arm 115. The slide block 41 is once again embodied as in the second variant of FIG. 2; however, the driver arm 115 is provided with a flange 46 that in combination with the locking key 42 determines the axial position of the slide block 41.

In FIG. 5, the second exemplary embodiment is shown, in which the driver arm 215 is secured on a ring 47 that is joined via a sleeve 48 to a second ring 49. Preferably the rings and the sleeve are all in one piece, the rings 47 and 49 being embodied as collars of this sleeve 48. The slide block 41, as in the second variant of FIG. 2, is fastened to the driver arm 215. The rings 47, 49 and sleeve 48 are threaded onto the rotary shaft 212, which in this case is again of circular cross section, and the ring 49 is firmly clamped via at least one screw 51. Bores 52 are also provided in the sleeve, for the sake of intentionally weakening a portion the sleeve 48. For the desired plastic deformation, the ring 47 is rotated relative to the ring 49, so that the sleeve portion 48 is rotated slightly in a helical manner, and the driver arm 215 undergoes the desired change in position relative to the rotational position of the rotary shaft 212.

Thus, it is believed to be apparent from the foregoing that one pertinent aspect of this application involves a sleeve which surrounds the rotary shaft with each end of the sleeve being rigidly secured to a respective collar. One of the collars is affixed to the rotary shaft and the other of the collars carrying a radially extending driver tang, the arrangement being such that the collars have an initial angular relationship. The driver tang is positioned in a transverse groove in a control slide. The sleeve is provided with means to permanently absorb a relative twist therein whereby upon being relatively twisted, the collars will thereafter remain in a specific relative angular relationship by virtue of the permanent absorption by the sleeve of a twist .

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the U.S. is:

1. A fuel injection pump for internal combustion engines, having a plurality of pump elements disposed in line in a pump housing and driven by a common camshaft, each having one pump piston and one pump cylinder and defining a pump work chamber, a control slide axially displaceable on each pump piston and controlling at least one control opening that discharges into the jacket face of the pump piston and communicates with a central blind bore of the pump piston that is open toward the pump work chamber, a suction chamber that surrounds the individual control slides and is defined by the pump housing and has an inlet side and outlet side through which fuel flows at low pressure, a driver arm, which is secured by a fastening element to a rotary shaft (12, 212) and which shaft via a driver means is adapted to engage an element on a device disposed on the control slide to thereby convert the rotational motion of the rotary shaft into an axial motion of the control slide, and means for variably adjusting the axial position of the control slides relative to one another by changing the position of the driver arm relative to the position of the rotary shaft by means of a permanent deformation of the material.

2. A fuel injection pump as defined by claim 1, in which the fastening element comprises a bolt (16; 116) which penetrates the rotary shaft (12; 112).

3. A fuel injection pump as defined by claim 2, in which the bolt (116) is riveted to the rotary shaft.

4. A fuel injection pump as defined by claim 2, in which the bolt (116) is screwed to the rotary shaft.

5. A fuel injection pump as defined by claim 2, in which the rotary shaft (12; 112) comprises a flattened face (37) proximate to the bolt (116), at least one protrusion defining at least one side of the flattened face and that a means complementary to said one protrusion is provided on the bolt (116) to secure the bolt (116) against rotation.

6. A fuel injection pump as defined by claim 1, in which the driver arm (115) comprises a tapered portion.

7. A fuel injection pump as defined by claim 2, in which the driver arm (115) comprises a tapered portion.

8. A fuel injection pump as defined by claim 3, in which the driver arm (115) comprises a tapered portion.

9. A fuel injection pump as defined by claim 4, in which the driver arm (115) comprises a tapered portion.

10. A fuel injection pump as defined by claim 5, in which the driver arm (115) comprises a tapered portion.

11. A fuel injection pump as defined by claim 6, in which the driver arm (115) has a substantially paraboloid longitudinal section, which is adapted to attain a uniform bending tension (deformation) over the bendable arm length (1).

12. A fuel injection pump as defined by claim 11, in which driver arm (115), in the vicinity of the bendable arm length (1), is embodied as a section of a thirdorder paraboloid.

13. A fuel injection pump as defined by claim 1, in which a sleeve surrounds the rotary shaft, each end of the sleeve rigidly secured to a respective collar, one of said collars fixed to the rotary shaft, the other of said collars carrying a radially extending driver tang, said driver tang being received in said transverse groove in said control slide, said collars having an initial angular relationship, said sleeve provided with means to permanently absorb a relative twist between said collars, whereby upon being relatively twisted, the collars will thereafter remain in a specific relative angular relationship by virtue of the permanent absorption by the sleeve of a twist.

14. A fuel injection pump as defined by claim 1, in which the driver arm (15; 115, 215) includes a cylindrical tang (14; 114) provided with a slide shoe which is secured thereto against axial displacement (39;41) said slide shoe being further adapted to engage a transverse groove (13) in said control slide.

* * * * *